US005733000A

United States Patent [19]

Stump

[11] Patent Number: 5,733,000

[45] Date of Patent: Mar. 31, 1998

[54] SURF BOARD SUPPORT AND CARRIER CHAIR COMBINATION

[76] Inventor: Kenneth Troy Stump, 7011 Candlelight Cir., Huntington Beach, Calif. 92647

[21] Appl. No.: 646,026

[22] Filed: May 7, 1996

[51] Int. Cl.[6] ..... A47C 7/62

[52] U.S. Cl. ..... 297/188.06; 248/309.1

[58] Field of Search ..... 297/188.04, 188.06, 297/188.01, 188.2, 183.5, 183.7, 183.6, 183.8, 183.1, 440.24, DIG. 1, 440.11, 440.1, 463.1; 248/309.1; 224/275

[56] References Cited

U.S. PATENT DOCUMENTS

| | | | |
|---|---|---|---|
| 1,361,056 | 12/1920 | Hickman | 248/309.1 X |
| 2,100,261 | 11/1937 | Montgomery | 297/188.06 X |
| 2,724,429 | 11/1955 | Warner | 297/183.8 X |
| 2,841,210 | 7/1958 | Nesselrodt | 297/188.06 |
| 2,890,800 | 6/1959 | Gibson | 297/188.06 X |
| 3,054,638 | 9/1962 | Johnson et al. | 297/188.06 X |
| 3,145,050 | 8/1964 | Edwards | 297/183.8 |
| 3,291,521 | 12/1966 | Krueger | 297/188.2 |
| 4,077,664 | 3/1978 | Harder, Jr. | 297/183.8 |
| 4,676,548 | 6/1987 | Bradbury | 297/188.04 X |
| 4,925,239 | 5/1990 | Powers | 297/31 |
| 5,044,650 | 9/1991 | Eberle, Jr. | 297/183.8 X |
| 5,054,732 | 10/1991 | Sukup | 248/309.1 |
| 5,139,308 | 5/1992 | Zinman . | |
| 5,244,225 | 9/1993 | Frycek | 297/183.8 X |
| 5,544,793 | 8/1996 | Harrop | 297/183.5 X |

*Primary Examiner*—Milton Nelson, Jr.
*Attorney, Agent, or Firm*—Curtis L. Harrington

[57] ABSTRACT

A surf board support enables formation of a beach chair and surf board support combination by the joining of a specialized surf board support and beach chair which may be available as a retro-fit or attachment to existing beach chairs, and provides self supporting protective vertical support for a surf board in order to keep sand and heat from destroying the waxed surface of a surf board. A padded strap is included which is attachable directly to the beach chair portion of the beach chair and surf board support to enable it to be carried as a single unit for long distances without fatigue.

9 Claims, 3 Drawing Sheets

SURF BOARD SUPPORT AND CARRIER CHAIR COMBINATION

FIELD OF THE INVENTION

The present invention relates to the field of beach furniture and particularly to a free standing chair and support and carrier for a surf board.

BACKGROUND OF THE INVENTION

Many items of beach furniture have been made which provide lounging capabilities and sun shading capabilities of various types. However, since in many areas the beach may not be parking accessible, there is a considerable walk to the beach. As a result, beach furniture needs not only to be made for comfort, but also for easy transport. In instances where beach furniture can be made to carry other items a further advantage is had.

Several known beach chairs have pockets and flaps for carrying small items. Each pocket and flap seriously complicates the manufacture of the beach chair causing additional sewing steps and additional steps in attaching snaps, flap buttons, and other securing closure devices. Since most beach furniture is considered to be semiexpendable, any additional cost due to further securing structures may add cost which will prohibit any serious market entry for such an item.

Further, conventional attachment structures tend to be non-focused. Most attachment and carriage structures are aimed at general items rather than any one given item. As a result, the structures are a hodge-podge of securing members which may or may not meet the needs of the beach-going public.

One of the focused areas mentioned involves the use of surf boards. Surfers must not expose their waxed boards to high temperatures. Laying a surf board down with the waxed surface facing the hot sand will cause the wax to be melted and or pick up some of the sand into the wax. Further waxing will cause the sand to become ground into the board. Laying the board down with the wax surface upward may also cause melting of the wax in direct sun light, particularly if the board is of darker color. It is most ideal to position the board vertically, either on its side or end.

End positioning in the sand can be difficult and cause damage to the end of the board which is "dug" into the sand. Even in an elongate vertical position, the wind can cause the board to blow over, causing the damage which is sought to be eliminated. Side positioning requires unacceptable insertion of the board into the sand and can be still partially damaging to the board.

Another problem is the positioning of the board during a day of surfing. No surfer wants to have to spend time to position a surfboard with respect to a support device, especially one which uses a strap, flap, or other securing device. Once a surfer has been out and has carried the board back to a beach location, he will be too tired to want to try to properly secure a board with straps, flaps, and the like. The surf board should be able to be dropped into and easily retrieved from a position of horizontal support.

Particularly among older surfers the need to sit down after a long period of surfing is acute. As such, the combination of a surf board support with beach chair furniture is a needed combination. The beach chair should be able to support the surf board regardless of whether the chair is in the folded or unfolded position. The chair should be moveable to the folded or unfolded position while supporting the surf board.

What is needed is an item of beach furniture which will readily enable a surf board to be supported with its surfaces vertically positioned and which facilitates the quick acceptance of the surf board. In Addition, the surf board and beach chair should be supported together in such a way that transport of the surf board and beach chair to and from the beach is facilitated.

SUMMARY OF THE INVENTION

The surf board support of the present invention enables the formation of a surf board support and beach chair combination as a simple device which accomplishes a number of advantageous goals. First, the support can be available as a retro-fit or attachment to existing beach chairs to enable users not to have to give up their favorite chairs in order to gain the advantages of the invention. Secondly, the surf board support causes the combination surf board support and beach chair to be self supporting in either the folded or unfolded position of the chair, to enable a surfer to readily drop his surf board onto the support regardless of the position of the chair. The support is provided with padding which protects the surf board on its side and one of its surfaces. The support has an optional cloth coverage area for advertising or personalizing the support.

In addition, a padded strap is provided which is attachable directly to the beach chair which enables the beach chair and surf board to be carried as a single unit for long distances without fatigue.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

The description and operation of the invention will be best described with reference to FIG. 1. A standard beach chair 11 is shown fitted with a surf board support 13 and carry strap 15 in accord with the present invention. In the attached position shown, the beach chair 11, surf board support 13 form the beach chair and surf board support 17 of the present invention, hereafter referred to as chair support 17.

Figure 1:
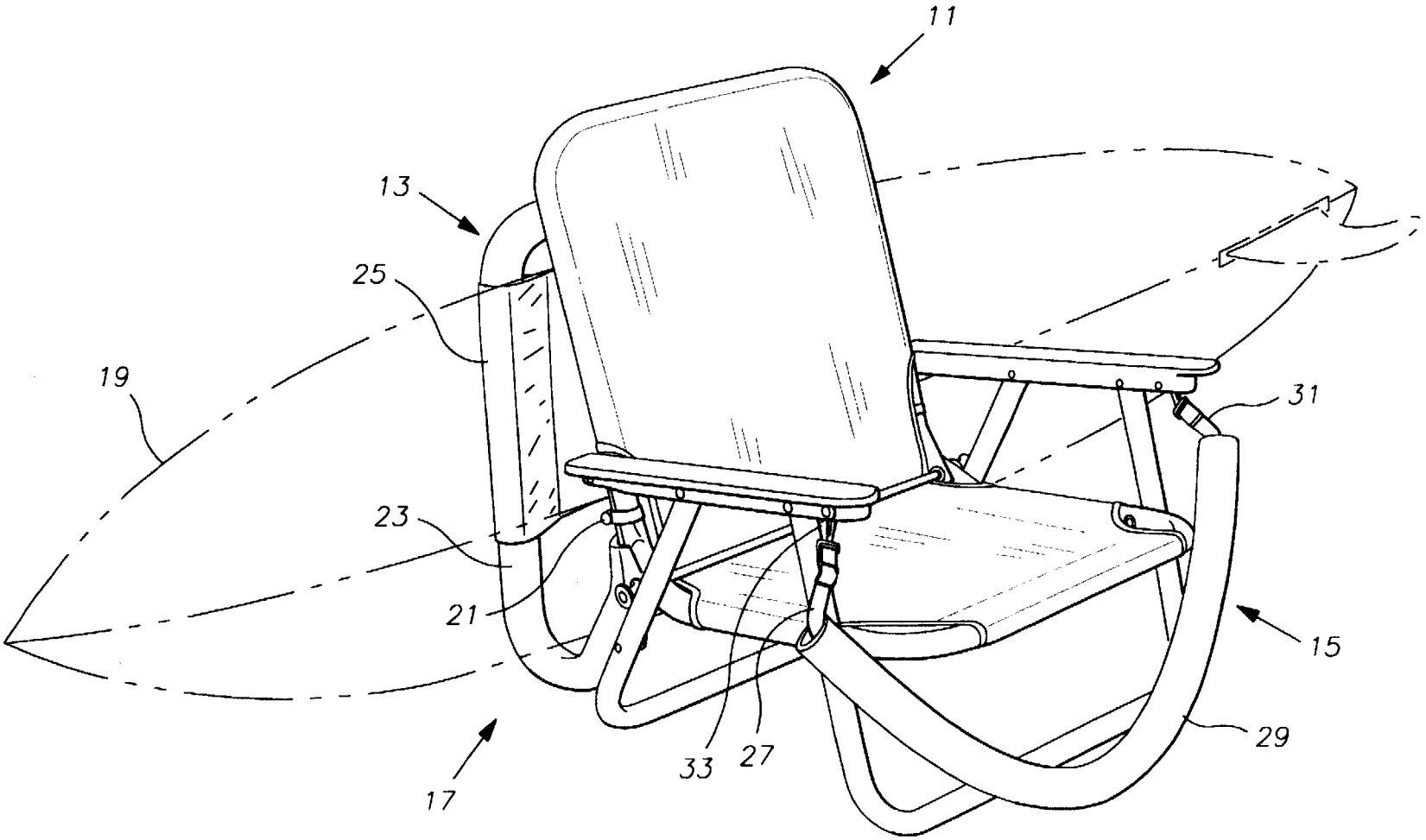
FIG. 1 is a perspective view of the beach chair and surf board support of the present invention with the beach chair in an unfolded position and a surf board shown in phantom and in a supported position.

The surf board support 13 is attached to the rear tubular members of the beach chair 11, using a pair of pipe clamps 21, one of which is shown in FIG. 1. The pair of pipe claims 21 are all that is needed to hold the surf board support 13 onto the beach chair 11. The surf board support 13 is made up of an elongate support structure of any geometry (to be shown) covered with a foam rubber protective layer 23. The surf board support 13 may also have a cloth web 25 which may act as shade for the surf board 19, or to facilitate the display of advertising.

Also shown in FIG. 1 at the front of the beach chair 11 is the carry strap 15 assembly made up of a single continuous length of strap 27 extending through a tubular length of foam rubber 29. The strap 27 has adjustment buckles 31 at the ends thereof to adjust the length of the strap 27. Each of the buckles support a snap hook 33 which can attach to any rod-like or other structure found on the beach chair 11. The carry strap 15 provides a padded structure to enable the user to carry the chair support 17 across the user's shoulder as is shown.

Other details of the beach chair 11 may vary depending upon the type of beach chair selected for use with the surf board support 13 and carry strap 15 to form the chair support 17 of the present invention. However, the manner of attachment is believed to be such as will be easily attached to most every type of standard beach chair 11.

Figure 2:
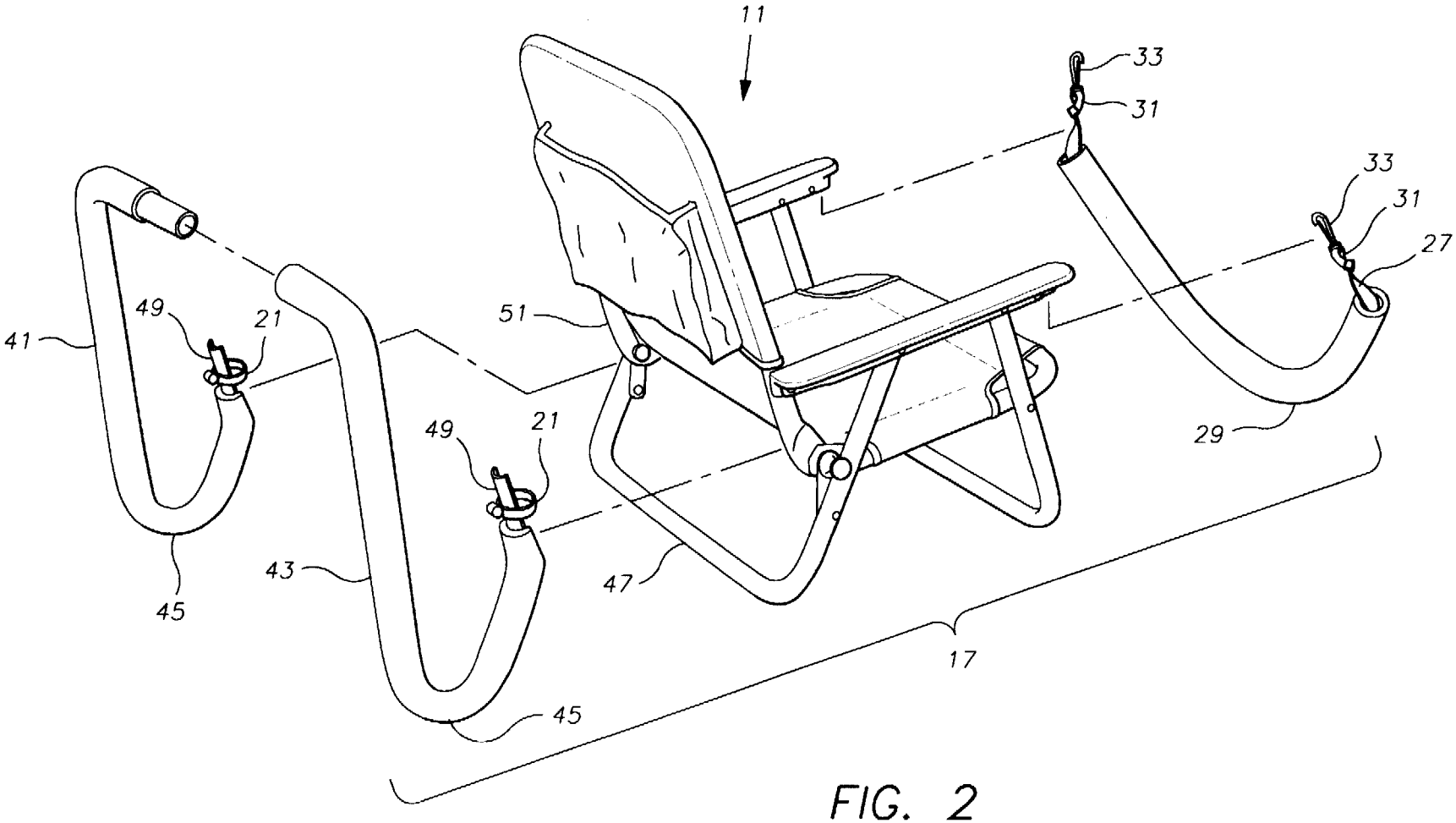
FIG. 2 is an exploded view illustrating a conventional beach chair apart from the surf board support portion and the carrying strap portion.

Referring to FIG. 2, an exploded view gives a clearer indication of the construction of the chair support 17 of the present invention. At the rear of the standard beach chair 11, the surf board support 17 is shown as being made up of two sections or lengths of structural support, in this case tubing, as a left section 41 and a right section 43. It is understood that any shape of structural support is possible and that the use of cylindrical tubing is only one expedient for accomplishing the goals of the present invention.

At the top of the sections 41 and 43 is some accommodation structure which enables the tube sections 41 and 43 to interfit. It is clear that the tubing of the surf board support 13 can be made as a single length of tubing, but that the use of tubing which slidably engages at the top thereof will enable the surf board support 13 to fit a wider variety of standard beach chairs 11.

FIG. 2 illustrates that the opening of the upper portion of the right section 43 is of greater diameter than the section of tubing at the upper portion of the left section 41. The range of lengths over which the left and right sections 41 and 43 interfit will depend on the range of widths of standard beach chairs 11 which are sought to be retro-fitted to form the chair support 17.

The lower ends of the tubing sections 41 and 43 dip through a minimum dimension to a lower elbow 45 which along with the other lower portions of standard beach chair 11, will enable the chair support 17 to be free-standing regardless of whether or not the beach chair 11 is in the folded or unfolded position. In FIG. 2, the rear bottom support loop 47 of the standard beach chair will form a balancing structure to the lower elbows 45.

The lower ends 47 of the left and right sections 41 and 43 turn upward and are bent into complementary semicircle sections portions to form curved sections 49 to fit closely alongside and together with any tubular portions of the beach chair 11. Even where the available tubular components on a beach chair 11 are square or otherwise non-round, the curved sections 49 will be engageable using the pipe clamps 21. The pipe clamps 21 are preferably of the screw-type and may be operated with a screw driver or socket wrench, or a wing nut which will facilitate manual attachment without tools.

As shown in FIG. 2, the curved sections 49 will provided to engage the surf board support 13. In the alternative, and where other structural members of the beach chair 11 permit, the upper curved sec engage an upper "U" section 51 of the beach chair 11. In this case, the upper "U" section of the chair 11 provides support to the surf board support 13. For other chairs 11, other structures may be differently shaped than the curved sections 49. Here, the curved sections 49 can be attached directly by the use of metal screws, whereas other sections having other shapes may be attached in still other ways.

It is remembered that the surf board support 13 is not relied upon for support for the beach chair 11 when the beach chair 11 is used in the open position for sitting. As such, there will normally not be any upward bending applied to the connection of the surf board support 13 to the beach chair 11.

When in resting position, and when the surf board 19 is supported there will be no undue forces at the point of connection of the surf board support 13 to the beach chair 11. The maximum forces will be developed on carriage of the surf board 19 when the beach chair 11 is carried and thus used to carry the surf board 19 through the surf board support 13. The orientation of the attachment geometry provides maximum supportive force on carriage of the surf board 19.

To attach the surf board support 13, the pipe clamps 21 need only be engaged about the sides of the upper "U" section 51 of the beach chair 11, and the curved sections 49 inserted between the pipe clamps 21 and the portions of the upper "U" section 51 of the beach chair 11. As the surf board 13 is positioned with respect to the beach chair 11, the upper portions of the left and right portions 41 and 43 are engaged with each other and axially moved closer together or farther apart to enable the curved sections 49 to align with their mating structures on the beach chair 11.

The foam rubber protective layer 23 may be provided in a single continuous length and completely cover the upper portion of the surf board support 13. In such a case, the width of the surf board support 13 could be determined and the additional length of the rubber protective layer 23 due to a narrow installation of the surf board support 13 could be trimmed away. In the alternative, a section of foam rubber protective layer can be added after adjustment of the width of the surf board support 13.

The cloth web 25 illustrated in FIG. 1 can be added in either a sewn or other fashion, and is completely optional. Also shown in FIG. 2 is a more illustrative view of the snap hook 33 at the ends of the carry strap 15.

Figure 3:
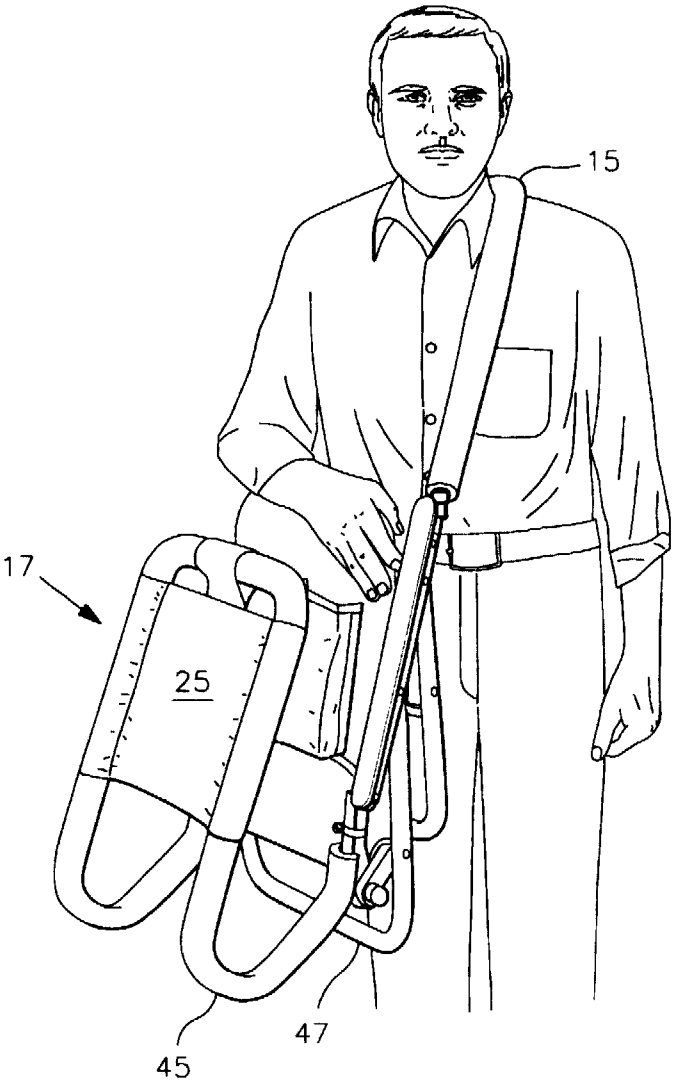
FIG. 3 illustrates the beach chair and surf board support in a carry position for both carriage of the surf board and when the surf board is absent, the surf board omitted for clarity.

Referring to FIG. 3, a perspective view with the beach chair 11 portion folded and the carry strap 15 being used by a user of the chair support 17 is shown. FIG. 3 omits the surf board 19 for clarity, but as can be seen, the surf board 19 can easily be balanced and supported by the chair support 17. The use of the carry strap 15 enables the surf board to be more easily carried. Where the carry strap 15 is not present, the upper portion of the surf board support 13 or either the upper portion of the beach chair 11's upper "U" section 51 can be grasped and the sure board 19 can be carried manually. The advantage, even in manual carriage, is the ability to set the assembly down, while the surf board is supported in an upright position.

Figure 4:
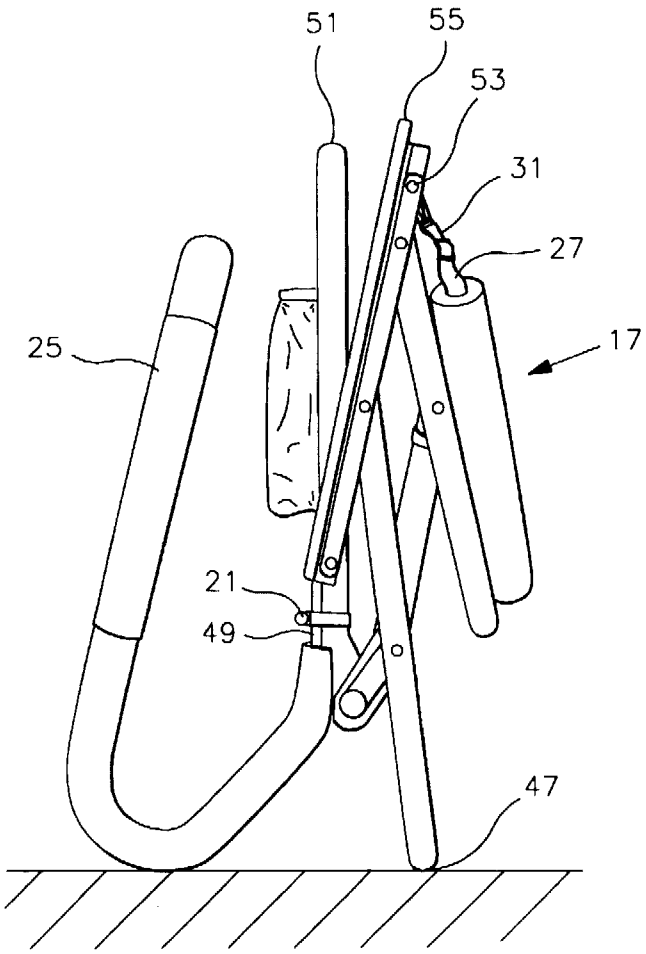
FIG. 4 is a side view of the beach chair and surf board support in a folded but free standing position.

Referring to FIG. 4, a side view of the chair support 17 illustrates the upright position which is achieved even while the beach chair 11 is in the folded position. Also seen is the end of a rivet pin 53 which extends across the inside lower portion of an arm 55 of the beach chair 11 and to which the snap hook 33 attaches. Other structures may be located on other beach chairs 11 which may also be engaged by the ends of the carry strap 15. For example, the snap hooks 33 can be looped around structures of the beach chairs 11 and have the snap hook 33 engage back onto a portion of the strap 31.

While the present invention has been described in terms of a chair support as well as structures for fitting onto existing beach furniture, one skilled in the art will realize that the structure and techniques of the present invention can be applied to many similar appliances. The present invention may be applied in any situation where both support and protection is desired.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A surf board support comprising:

a first length of tubing having a first end shaped to facilitate attachment to a folding chair, extending down and then up through a first elbow, and up, and across to a first portion of tubular fitting;

a second length of tubing having a second end shaped to facilitate attachment to said folding chair, extending down and then up through a second elbow, and up, and across to a second portion of tubular fitting which is slidably interfittable with said first portion of tubular fitting;

attachment fittings for attaching said first and said second lengths of tubing to a folding chair at said shaped ends, said first and second elbows of sufficiently large radius to facilitate and support a surf board and for enabling said folding chair, when said support is attached to stand vertically whether said folding chair is in an unfolded or folded position, and wherein the slidably interfittable first and second portions of tubular fittings enable said first and second ends to attach to various widths of said folding chair.

2. The surf board support of claim 1 and further comprising an area of webbing material attached to said first and second lengths of tubing.

3. The surf board support of claim 1 wherein said fittings enable attachment of said first and said second ends at variable height on said folding chair.

4. The surf board support of claim 1 wherein said first and said second ends of said length of tubing are shaped by being flattened to an elongate shape having a crescent shaped cross section to facilitate attachment to a cylindrical surface on said folding chair.

5. The surf board support of claim 1 wherein said attachment fittings are a pair of hose clamps for surrounding the ends of said tube joinably with structures on said folding chair.

6. The surf board support of claim 1 and further comprising foam padding surrounding at least a portion of said first and second lengths of tubing, and covering a point where said first portion of tubular fitting is immediately adjacent said second portion of tubular fitting.

7. The surf board support of claim 1 and wherein said first end and said first elbow of said first length of tubing lie in a first plane and wherein said second end and said second elbow of said second length of tubing lie in a second plane parallel to said first plane.

8. The surf board support of claim 7 and wherein the portion of said first and said second lengths of tubing which extend down and then up, and across to said first and second portions of said tubular fittings lie in a third plane perpendicular to said first and said second planes.

9. A surf board support comprising:

a length of support having a first end, extending through a first elbow, and up, across and down through a second elbow and up to a second end, and wherein the portion of said length of support which extends up, across and down lies in a third plane perpendicular to first and second planes, and wherein said first end and said first elbow lie in said first plane, and wherein said second end and said second elbow lie in said second plane parallel to said first plane;

attachment means for attaching said first and said second ends of said support to a folding chair;

a carry strap connectable to a beach chair to enable said beach chair and surf board support to be more easily carried while supporting a surf board and wherein said carry strap further comprises:

a first snap hook connector;

a tubular length of foam rubber;

a length of material having a first end attached to said first snap hook connector and extending into and out of said tubular length of foam rubber and terminating in a second end; and a second snap hook connector connected to said second end of said length of material; and wherein said beach chair has structures onto which said first and said second snap hook connectors can attach to facilitate the carrying of said beach chair and surf board support.

* * * * *